US009091997B2

(12) United States Patent
Arimura

(10) Patent No.: US 9,091,997 B2
(45) Date of Patent: Jul. 28, 2015

(54) IMAGE FORMING APPARATUS

(71) Applicant: CANON KABUSHIKI KAISHA, Tokyo (JP)

(72) Inventor: Koji Arimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 13/903,112

(22) Filed: May 28, 2013

(65) Prior Publication Data

US 2014/0003827 A1 Jan. 2, 2014

(30) Foreign Application Priority Data

Jun. 29, 2012 (JP) ..... 2012-146421

(51) Int. Cl.
*G03G 15/06* (2006.01)
*G03G 21/00* (2006.01)
*G03G 15/00* (2006.01)

(52) U.S. Cl.
CPC ..... *G03G 21/0011* (2013.01); *G03G 15/5008* (2013.01)

(58) Field of Classification Search
CPC ..... G03G 15/0131; G03G 15/0808; G03G 15/5008; G03G 2215/0838
USPC ..... 399/43, 53, 234, 236, 260, 264
See application file for complete search history.

(56) References Cited

U.S. PATENT DOCUMENTS

| | | | | |
|---|---|---|---|---|
| 7,734,206 | B2 * | 6/2010 | Ishida | 399/58 |
| 2008/0240757 | A1 * | 10/2008 | Suzuki | 399/53 |
| 2011/0268463 | A1 * | 11/2011 | Kimura et al. | 399/53 |

FOREIGN PATENT DOCUMENTS

| | | | |
|---|---|---|---|
| JP | 2003-186369 | A | 7/2003 |
| JP | 2005-250215 | A | 9/2005 |
| JP | 2006-139111 | A | 6/2006 |
| JP | 2007-47389 | A | 2/2007 |
| JP | 2007-108252 | A | 4/2007 |
| JP | 4048771 | B2 | 2/2008 |
| JP | 2009-122227 | A | 6/2009 |
| JP | 4554336 | B2 | 9/2010 |
| JP | 4906285 | B2 | 3/2012 |
| JP | 5049482 | B2 | 10/2012 |
| JP | 5130872 | B2 | 1/2013 |

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A representative configuration of an image forming apparatus according to the present invention includes a torque meter configured to gauge a rotation load of a photosensitive drum, and a controller configured to control whether to drive a development sleeve when the photosensitive drum is rotated during non image formation or control a driving speed of the development sleeve when the photosensitive drum is rotated during non image formation, based on a difference between first dynamic torque of the photosensitive drum when the development sleeve is rotated at a first speed and second dynamic torque of the photosensitive drum when the development sleeve is stopped or when the development sleeve is rotated at a second speed smaller than the first speed.

12 Claims, 14 Drawing Sheets

*FIG. 5*

| EXPERIMENT NO. | DEVELOPMENT SLEEVE ROTATION SPEED LEVEL DURING NON IMAGE FORMING TIME | DEVELOPMENT SLEEVE ROTATION SPEED (mm/s) | DYNAMIC TORQUE DYNAMIC TORQUE (mN · m) | DIFFERENCE OF DYNAMIC TORQUE ΔF (mN·m) | DIFFERENCE OF DYNAMIC TORQUE ΔF/DYNAMIC TORQUE AT Vs × 100(%) | CLEANING DEFECT (CONTAMINATION OF CHARGING MEMBER) |
|---|---|---|---|---|---|---|
| CONVENTIONAL EXAMPLE | V0 | 0 | 343 | 49 | 16.7 | × |
| 1 | V1 | 36 | 336.1 | 42.1 | 14.3 | × |
| 2 | V2 | 72 | 328.3 | 35.3 | 12.0 | × |
| 3 | V3 | 144 | 300.8 | 6.8 | 2.3 | ○ |
| 4 | V4 | 216 | 299.8 | 5.8 | 2.0 | ○ |
| 5 | V5 | 288 | 295.9 | 1.9 | 0.6 | ○ |
| 6 | Vs | 360 | 294 | 0 | 0.0 | ○ |

*FIG. 9*

| ΔF' LEVEL | 1 | 2 | 3 | 4 | 5 | 6 |
|---|---|---|---|---|---|---|
| DEVELOPMENT SLEEVE ROTATION SPEED (Vh) DURING NON IMAGE FORMATION | V0 | V1 | V2 | V3 | V4 | Vs |

IMAGE FORMING APPARATUS

BACKGROUND OF THE INVENTION

1. Field of the Invention

The present invention relates to an image forming apparatus such as a copying machine, a printer, and a facsimile machine.

2. Description of the Related Art

In a conventional image forming apparatus, as an image bearing member receives a discharge from a charging member, a discharge product attaches to a surface of the image bearing member, and endurance gradually raises a frictional force between the image bearing member and a cleaning blade. When the frictional force between the image bearing member and the cleaning blade increases, followability of the cleaning blade with respect to the image bearing member becomes unstable, causing a chattering phenomenon in which the cleaning blade bounces or causing a turning-over phenomenon in which the cleaning blade is reversed. Thereby, the amount of toner slipping through increases and image defects are caused.

Therefore, a method has been proposed which reduces the frictional force by developing a belt-shaped toner belt and sending toner between the image bearing member and the cleaning blade. Japanese Patent Laid-Open no. 2005-250215 (Patent literature 1) proposes a method of changing an imaging frequency of a toner belt according to use history of a cleaning blade and an image bearing member. Also, Japanese Patent laid-Open no. 2006-139111 (Patent literature 2) proposes a method of forming a toner belt when an image area ratio is equal to or less than a predetermined level.

However, even when toner supply is performed as described above, an abrupt change of the frictional force between the image bearing member and the cleaning blade during a printing operation can change driving load torque (dynamic torque) of the image bearing member.

FIGS. 12A and 12B are diagrams illustrating an abutting state of an image bearing member and a cleaning blade. FIG. 12A illustrates a state in which a frictional force between the image bearing member and the cleaning blade is high, and FIG. 12B illustrates a state in which the frictional force is low. In the state of FIG. 12A, the abutting portion of the cleaning blade is drawn in a downstream side to a large extent from an abutting position while being stopped. In the state of FIG. 12B, the downstream-side drawing-in amount of the abutting portion of the cleaning blade is smaller as compared with FIG. 12A.

An abrupt change of blade behavior forces toner, which has accumulated near the cleaning blade, to slip through little by little from contact portions of the cleaning blade and the image bearing member. The toner that has slipped through contaminates the surface of the charging member, which lies downstream in the rotation direction of the image bearing member, and causes local latent image unevenness, or the toner is transferred onto a sheet and results in image defects.

In this regard, a method is also considered which supplies the cleaning blade with fog toner by rotating a development sleeve at a low speed during a non image forming time, in order to suppress any abrupt change of blade behavior when switching from the non image forming time to an image forming time. However, there is a concern that the developer will degrade as much as the development sleeve is rotated.

SUMMARY OF THE INVENTION

Therefore, it is desirable to provide an image forming apparatus capable of both suppressing slipping-through of toner resulting from an abrupt change of the abutting state of the cleaning blade before image formation and suppressing developer degradation resulting from a rotation of the developer bearing member as much as possible.

In order to solve the above problem, a representative configuration of an image forming apparatus includes: an image bearing member configured to bear an electrostatic latent image; a developer bearing member configured to bear a developer on a surface and develop the electrostatic latent image borne by the image bearing member as a toner image; a cleaning blade configured to abut onto the image bearing member and clean the developer remaining on the image bearing member after transfer; a sensing portion configured to sense a rotation load of the image bearing member; and a controller configured to perform control such that a driving mode can be performed to drive the developer bearing member at a lower speed than that during an image forming time when the image bearing member is rotated during non image formation, wherein the controller is enabled to perform a torque sensing mode which determines whether to perform the driving mode or determines a driving speed of the developer bearing member during the driving mode, based on first dynamic torque of the image bearing member when the developer bearing member is rotated at a first speed and second dynamic torque of the image bearing member when the developer bearing member is stopped or when the developer bearing member is rotated at a second speed smaller than the first speed.

Further features of the present invention will become apparent from the following description of exemplary embodiments with reference to the attached drawings.

BRIEF DESCRIPTION OF THE DRAWINGS

FIG. 5 is a diagram illustrating an experiment result according to the present embodiment.

FIG. 9 is a diagram illustrating a table for development sleeve rotation speed determination used in the third embodiment.

DESCRIPTION OF THE EMBODIMENTS

First embodiment

Figure 1:
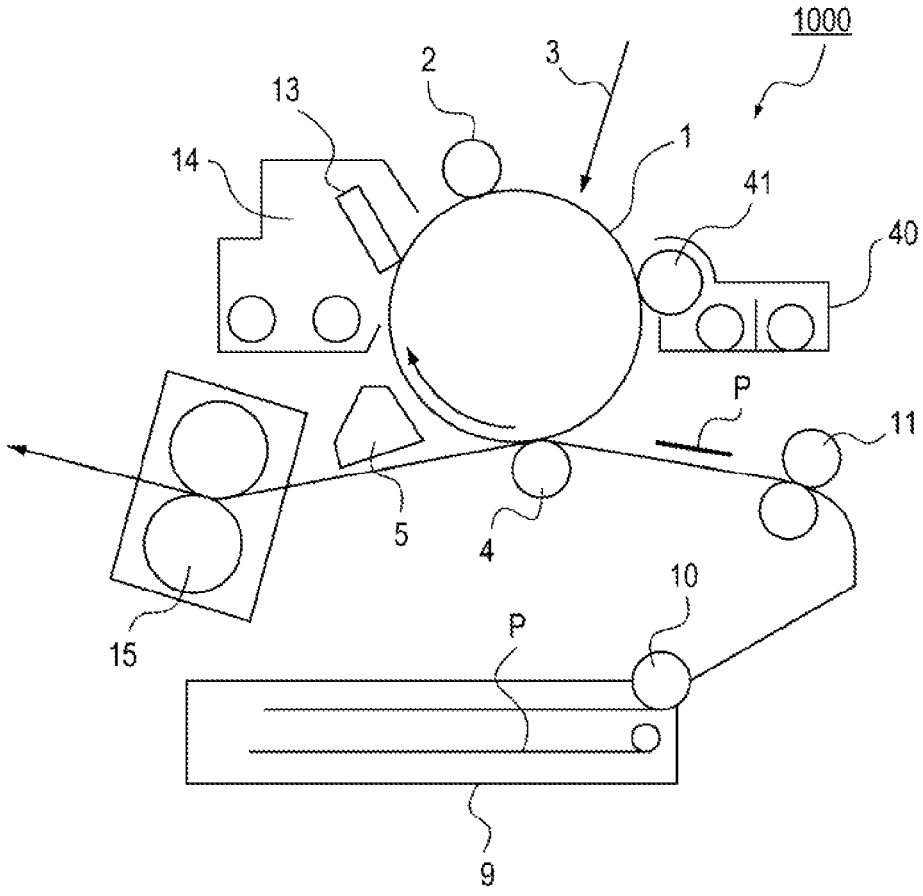
FIG. 1 is a configuration diagram of an image forming apparatus according to a first embodiment.

A first embodiment of an image forming apparatus according to the present invention will be described with reference to the accompanying drawings. FIG. 1 is a configuration diagram of an image forming apparatus 1000 according to the present embodiment.

As illustrated in FIG. 1, in the image forming apparatus 1000 according to the present embodiment, a photosensitive drum (image bearing member) 1 is charged by a charging roller (charging member) 2 and is exposed to laser light 3 which conforms to image information, so that an electrostatic latent image is formed. By a development sleeve (developer bearing member) 41 of a development device 40, the formed electrostatic latent image is developed as a toner image using toner.

On the other hand, a sheet P contained in a cassette 9 is conveyed to nip portions (transfer portions) of the photosensitive drum 1 and a transfer roller 4 by a feed roller 10 and a registration roller 11 so that a toner image is transferred. The sheet P, to which the toner image has been transferred, is separated from the photosensitive drum 1 by a separating charger 5, is heated/pressurized by a fixing device 15 so that the toner image is fixed, and is discharged out of the apparatus. After the transfer of the toner image, toner remaining on the surface of the photosensitive drum 1 is scraped from the surface of the photosensitive drum 1 by a cleaning blade 13 of a cleaning device 14 which elastically abuts onto the photosensitive drum 1.

Figure 2A:
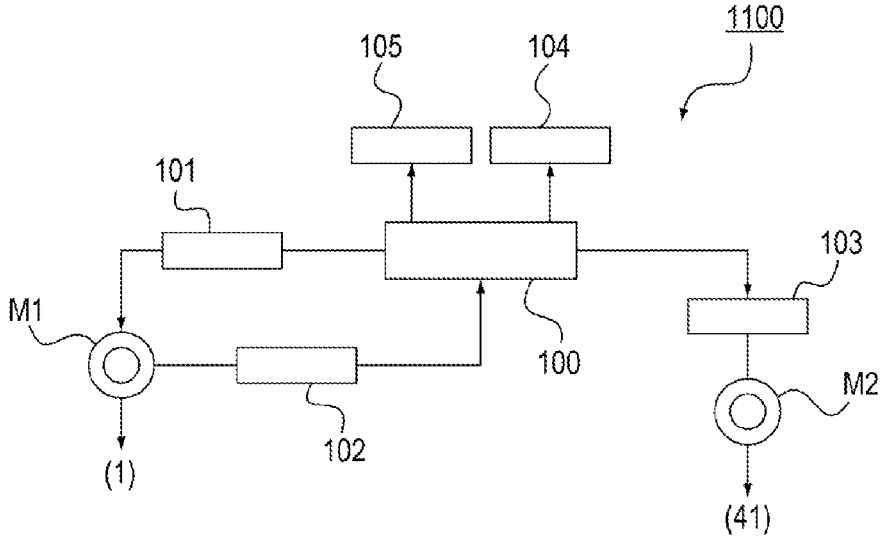
FIG. 2A is a block diagram of a controller of the image forming apparatus according to the first embodiment.

(Controller) FIG. 2A is a block configuration diagram of a control configuration of the image forming apparatus 1000 according to the present embodiment. Referring to FIG. 2A, the control configuration 1100 includes a controller 100, a driver 101, a torque meter (gauging unit) 102, a driver (switching unit) 103, a memory (memorizing unit) 104, and a counter (charging time gauging unit (gauging unit), image forming sheet number counting unit (gauging unit)) 105. Based on results of gauging and prediction of a rotation load of the photosensitive drum 1 by the torque meter 102 and the counter 105, the controller 100 switches the rotation speed of the development sleeve 41 during non image formation by the driver 103. Specifically, based on a difference (change amount ΔF) between first dynamic torque of the photosensitive drum 1 when the development sleeve 41 is rotated at a first speed and second dynamic torque of the photosensitive drum 1 when the development sleeve 41 is stopped or when the development sleeve 41 is rotated at a second speed lower than the first speed, the controller 100 controls whether to drive the development sleeve 41 when the photosensitive drum 1 is rotated during non image formation or controls the driving speed of the development sleeve 41 when the photosensitive drum 1 is rotated during non image formation.

The controller 100 controls a motor M1, which drives the photosensitive drum 1, via the driver 101. The controller 100 controls a motor M2, which drives the development sleeve 41, via the driver 103 such that the rotation speed of the development sleeve 41 is switched.

The torque meter 102 is a gauging unit configured to gauge the rotation load (dynamic torque) of the photosensitive drum 1. As the torque meter 102, a torque converter-type device or a device configured to gauge torque based on a driving current value of the motor M1 is used.

The counter 105 gauges charging time of the photosensitive drum 1. Also, the counter 105 counts the number of image formations.

Figure 2B:
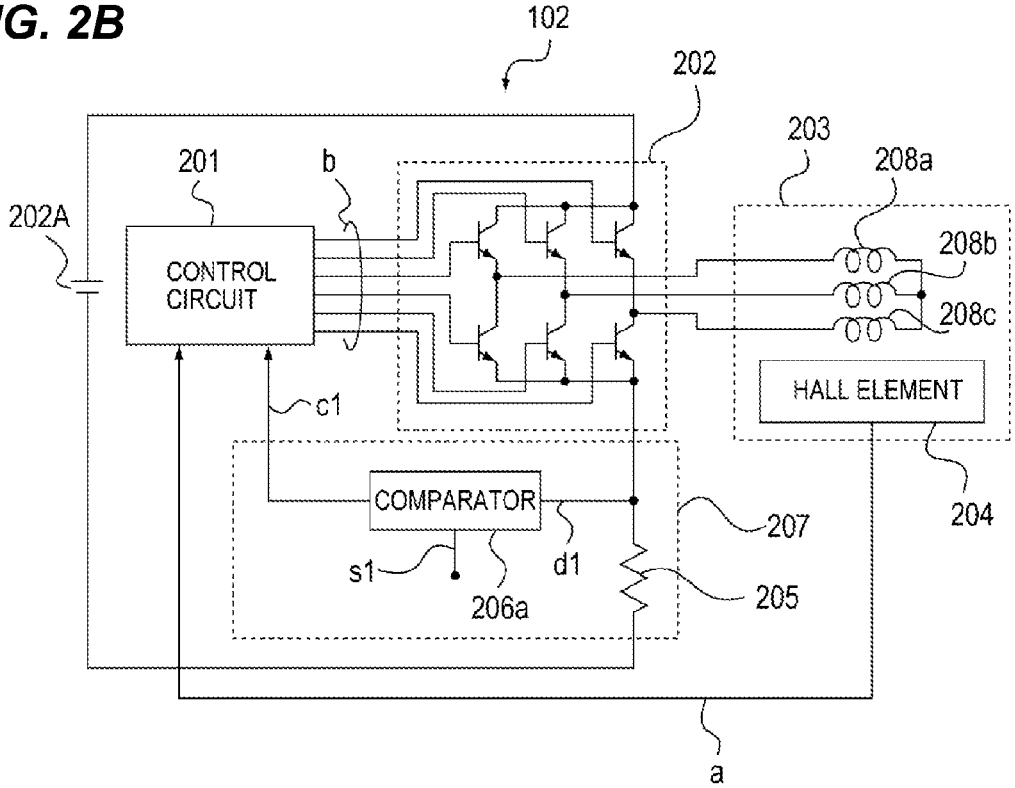
FIG. 2B is a block configuration diagram of a unit for measuring a driving load of an image bearing member.

FIG. 2B is a configuration diagram of a brushless DC motor 203 and the torque meter 102 according to the present embodiment. As illustrated in FIG. 2B, in the present embodiment, a brushless DC motor 203 is used as the motor M1, and the torque meter 102 gauges dynamic torque of the photosensitive drum 1 using a detection current signal of the brushless DC motor 203.

The brushless DC motor 203 includes motor coils 208*a* to 208*c*. The torque meter 102 includes a control circuit 201, a driving element 202, a driving power supply 202A, a hall element 204, and a current detection unit 207. The brushless DC motor 203 is driven by the driving element 202 and the driving power supply 202A. The Hall element 204 detects the magnetic pole position of a rotor embedded in the brushless DC motor 203. The current detection unit 207 includes a current detection resistor 205 and a comparator 206*a*.

The control circuit 201 receives a magnetic pole position signal a, which is output by the Hall element 204, and outputs a control signal b which controls the driving element 202. The driving element 202 is controlled by the control signal b and drives the brushless DC motor 203. At this time, a detection current signal d1, a reference signal s1, and a current limit signal c1 are applied to the control circuit 201, which performs control such that the current flowing through the brushless DC motor 203 does not exceed a set limit value.

The detection current signal d1 is obtained by detecting a current, which flows from the driving power supply 202A to the brushless DC motor 203, by the current detection resistor 205. In the present embodiment, a rotation load of the brushless DC motor 203 is calculated from the detection current signal d1 and is considered as dynamic torque of the brushless DC motor 203. The reference signal s1 sets a maximum current flowing through the brushless DC motor 203. The current limit signal c1 is generated by the current detection unit 207.

(Normal Printing Operation and Operation of Gauging Dynamic Torque of Photosensitive Drum 1)

Figure 3A:
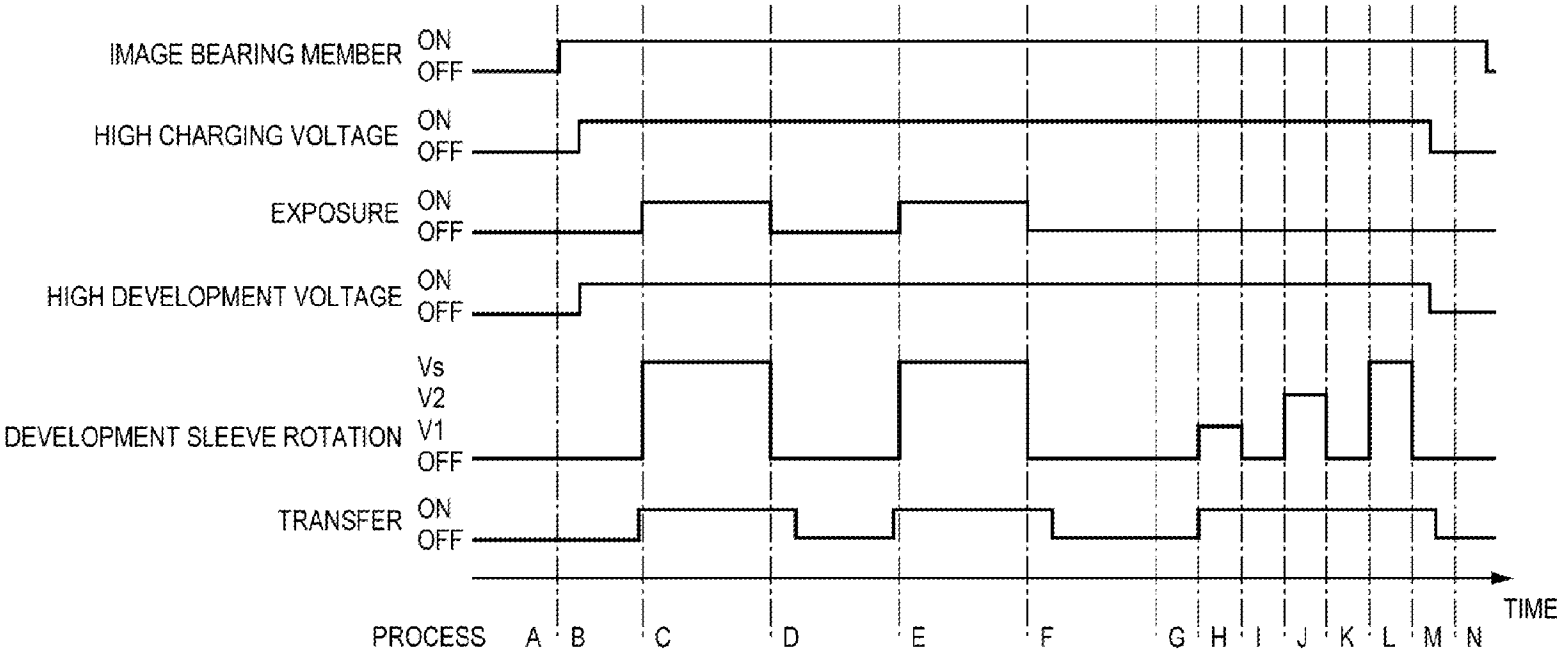
FIG. 3A is a timing chart of a normal printing operation and dynamic torque gauging control in the image forming apparatus according to the first embodiment.

FIG. 3A is a timing chart of a normal printing operation (processes A to F) and an operation of gauging dynamic torque of the photosensitive drum 1 (processes G to H) in the image forming apparatus 1000.

First, during the normal printing operation (processes A to F), the photosensitive drum 1 receives a command for a printing operation in a standby state (process A) and starts pre-rotation, A high charging voltage and a high development voltage are applied almost in synchronization (process B). Then, image formation for the first sheet is performed (process C). Subsequently, inter-sheet rotation is performed, and discharge of the first sheet P and preparation for image formation for the second sheet are performed (process D). Thereafter, image formation for the second sheet is performed (process E). Subsequently, post-rotation is performed, and the second sheet P is discharged (process F).

Next, during an operation of gauging dynamic torque of the photosensitive drum 1 by the torque meter 102 (processes G to H), in a state in which the development sleeve 41 does not rotate (development sleeve rotation speed V0=0), torque (reference torque) of the photosensitive drum 1 is measured (process G). Subsequently, dynamic torque measurement is performed in processes H, J, and L of the slowest development sleeve rotation speed V1 (process H), development sleeve rotation V2 (process J) faster than V1, and development sleeve rotation Vs (process L) during an image forming time, which is faster than V2, respectively. (A dynamic torque sensing mode is performed)

Thereafter, by way of post-rotation of dynamic torque change measurement (process M), the high charging voltage and the high development voltage are turned off, and the photosensitive drum 1 stops rotating (process N).

Although reference torque for calculating the dynamic torque change at each development sleeve speed is gauged during process G in the present embodiment, the reference torque can also be gauged in states (process I and process K) of no sleeve rotation before processes J and L.

In the present embodiment, when a toner image for dynamic torque change gauging is supplied to a cleaning portion (between the cleaning blade 13 and the photosensitive drum 1), the high charging voltage and the high development voltage are turned on, in order to assume the same condition as during an actual printing operation.

Also, the time interval (time of process I and process K) for changing the rotation speed of the development sleeve 41 is set at least as large as the time for one rotation of the photosensitive drum 1, enabling precise gauging. This is because, by making measurements in the same position on the circumference of the drum, circumferential deviation can be decreased. This is also because measurements can be made after stabilizing the amount of toner and external additive remaining on the cleaning portion.

Also, although dynamic torque measurements are performed at two development sleeve rotation speeds V1 and V2 besides Vs in this case, measurements can be performed at four or more development sleeve rotation speeds below Vs (below rotation speed during image formation). This makes it possible to select a speed at which the dynamic torque change amount ΔF (described later) becomes smaller.

Figure 3B:
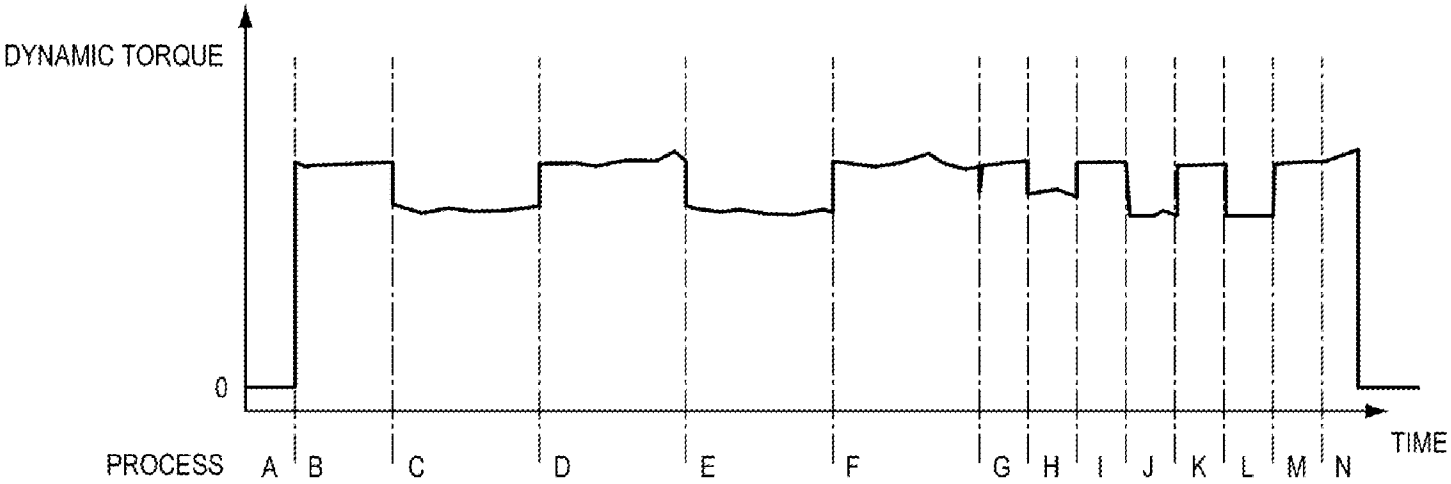
FIG. 3B illustrates a dynamic torque transition during a cycle of a printing operation according to the first embodiment.

FIG. 3B is a diagram illustrating a transition of a rotation load (dynamic torque) of the photosensitive drum 1 during the operation of FIG. 3A. It is obvious from the dynamic torque transition of FIG. 3B that, during the pre-rotation (process B), inter-sheet rotation (process D), and post-rotation (process F), dynamic torque of the photosensitive drum 1 is made high by application of high charging voltage and sleeve rotation stop.

It is also obvious that, during processes C, E, H, J, and L, dynamic torque becomes low when a toner image has come to the cleaning blade 13.

In this case, the differences of dynamic torque of process B and process C, process C and process D, process D and process E, process E and process F, process G and process H, process I and process J, and process K and process L respectively indicate a difference before and after fog toner reaches the cleaning blade 13, and indirectly represents sliding property of the surface of the photosensitive drum 1.

Also, the differences of dynamic torque of process G and process H, process I and process J, and process K and process L respectively reflect a decrease of dynamic torque resulting from a difference of development sleeve rotation speed.

The difference of dynamic torque taken during the above-mentioned combinations of processes is the dynamic torque change amount ΔF. In FIG. 3B, from process B to process C, from process C to process D, from process D to process E, and from process E to process F, the dynamic torque change amount ΔF is large. Consequently, an abrupt change of a frictional force between the photosensitive drum 1 and the cleaning blade 13 results in slipping-through of toner.

(Control for Decreasing Dynamic Torque Change Amount ΔF)

Therefore, according to the present embodiment, the development sleeve is rotated during the pre-rotation (process B), the inter-sheet rotation (process D), and the post-rotation (process F), and the dynamic torque change amount ΔF is decreased accordingly.

Figure 4A:
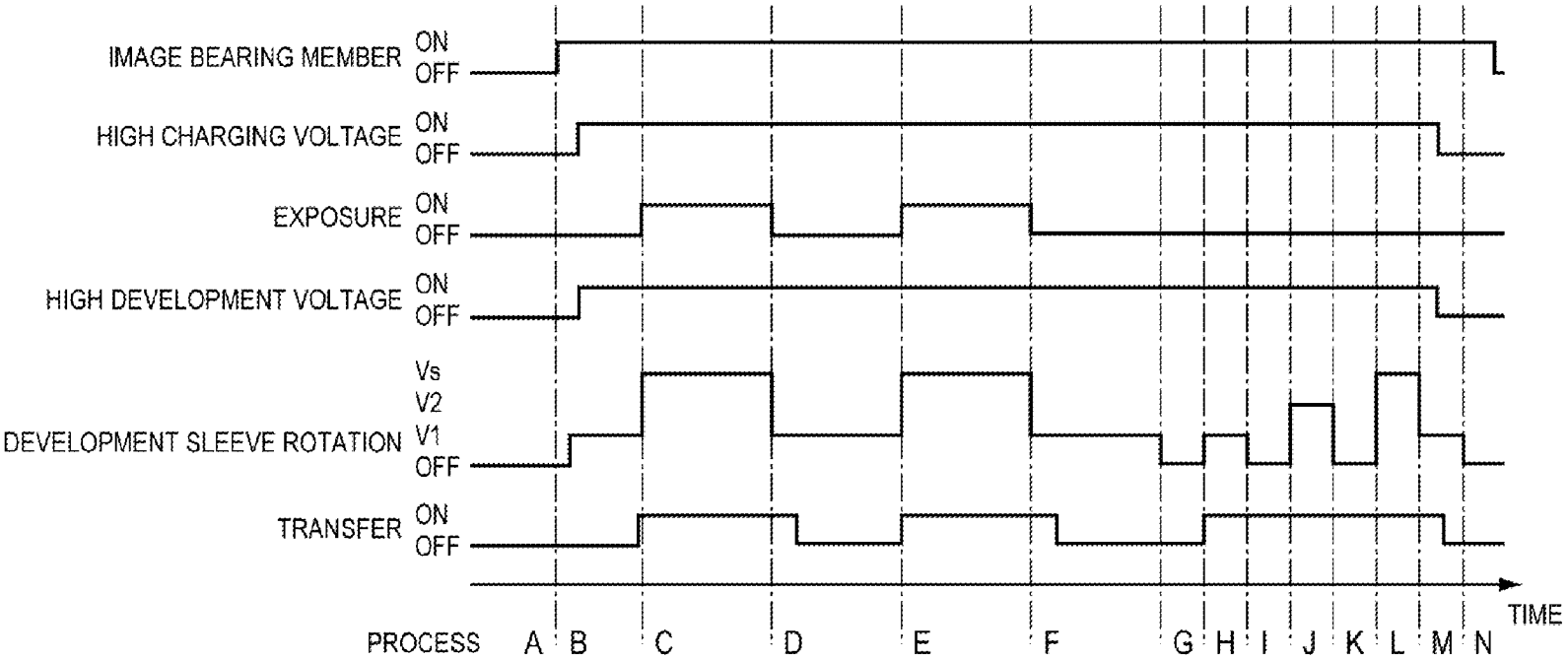
FIG. 4A is a timing chart of a printing operation when control for decreasing a dynamic torque change amount ΔF according to the first embodiment is applied.
Figure 4B:
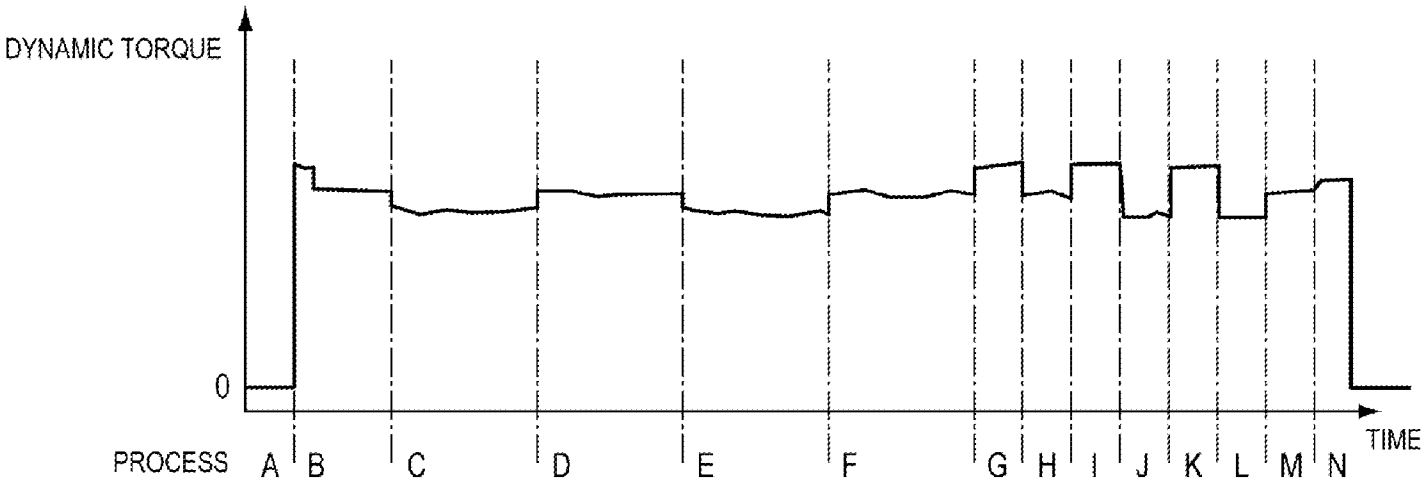
FIG. 4B is a diagram illustrating a transition of a rotation load (dynamic torque) of a photosensitive drum during the operation of FIG. 4A.

FIG. 4A is a timing chart of a printing operation when control for decreasing ΔF according to the present embodiment is applied. FIG. 4B is a diagram illustrating a transition of a rotation load (dynamic torque) of the photosensitive drum 1 during the operation of FIG. 4A.

As illustrated in FIG. 4A, in the case of the control for decreasing ΔF according to the present embodiment, compared with the timing chart of FIG. 3A, the development sleeve is rotated at a speed of V1 during the pre-rotation (process B), the inter-sheet rotation (process D), and the post-rotation (process F).

As illustrated in FIG. 4B, when the control according to the present embodiment is applied, compared with a case where the control according to the present embodiment of FIG. 3B is not applied, the dynamic torque change amount ΔF from process B to process C, from process D to process E, and from process E to process F has decreased.

Such a decrease of the dynamic torque change amount ΔF prevents slipping-through of toner resulting from an abrupt change of a frictional force between the photosensitive drum 1 and the cleaning blade 13.

(Comparison Experiments)

Experiments for comparing the present embodiment with a conventional example were performed under the following conditions. The sleeve rotation speed during a non image forming time, such as at pre-rotation, post-rotation, and inter-sheet rotation, was set as in the following conventional examples, i.e. Experiment 1 to Experiment 5, and one-hour endurance experiments were performed.

(Common Conditions)

Conditions common to the conventional example and Experiments 1 to 5 were set as follows. Experiment machine used: IRC3380 modified machine, experiment environment temperature: 30° C., and experiment environment humidity: 80%. Process speed: 200 mm/sec, number of sheets printed for one minute: six sheets of A4 transverse size. Primary charging AC bias: 1,600 Vpp, primary charging DC bias: −500 V, and development DC bias: −350 V. Development sleeve outer diameter: 16 mm, cleaning blade average linear pressure: 35 gf/cm, toner amount during development sleeve rotation: 0.02 mg/cm$^2$, and photosensitive drum driving torque at development sleeve rotation speed Vs: 2094 mN·m, development sleeve rotation speed Vs during an image forming time: 360 mm/sec.

(Conditions of Sleeve Rotation Speed During Non Image Forming Time)

The sleeve rotation speed during a non image forming time was set to the following conditions. Conventional example: development sleeve rotation speed V0: 0 mm/sec. Experiment 1: development sleeve rotation speed V1: 36 mm/sec. Experiment 2: development sleeve rotation speed V2: 72 mm/sec. Experiment 3: development sleeve rotation speed V3: 144 mm/sec. Experiment 4: development sleeve rotation speed V4: 215 mm/sec. Experiment 5: development sleeve rotation speed V5: 288 mm/sec.

FIG. 5 is a diagram illustrating results of the above-mentioned experiments. The difference of dynamic torque (dynamic torque difference) ΔF is a difference between dynamic torque at each rotation speed and dynamic torque during rotation at Vs. As illustrated in FIG. 5, in the cases of the conventional examples, Experiment 1 and Experiment 2, contamination of the charging roller 2 has caused image defects. In the cases of Experiment 3 to Experiment 5, contamination of the charging roller 2 is insignificant, causing no image defects.

In other words, rotation at sleeve speed V3 or higher during a non image forming time is obviously recommended.

Also, the rotation distance of the development sleeve in the case of V3 corresponds to ⅖ of the rotation distance of the development sleeve during an image forming time, making it possible to substantially suppress degradation of the developer.

(Control Flow According to the Present Embodiment)

Figure 6:
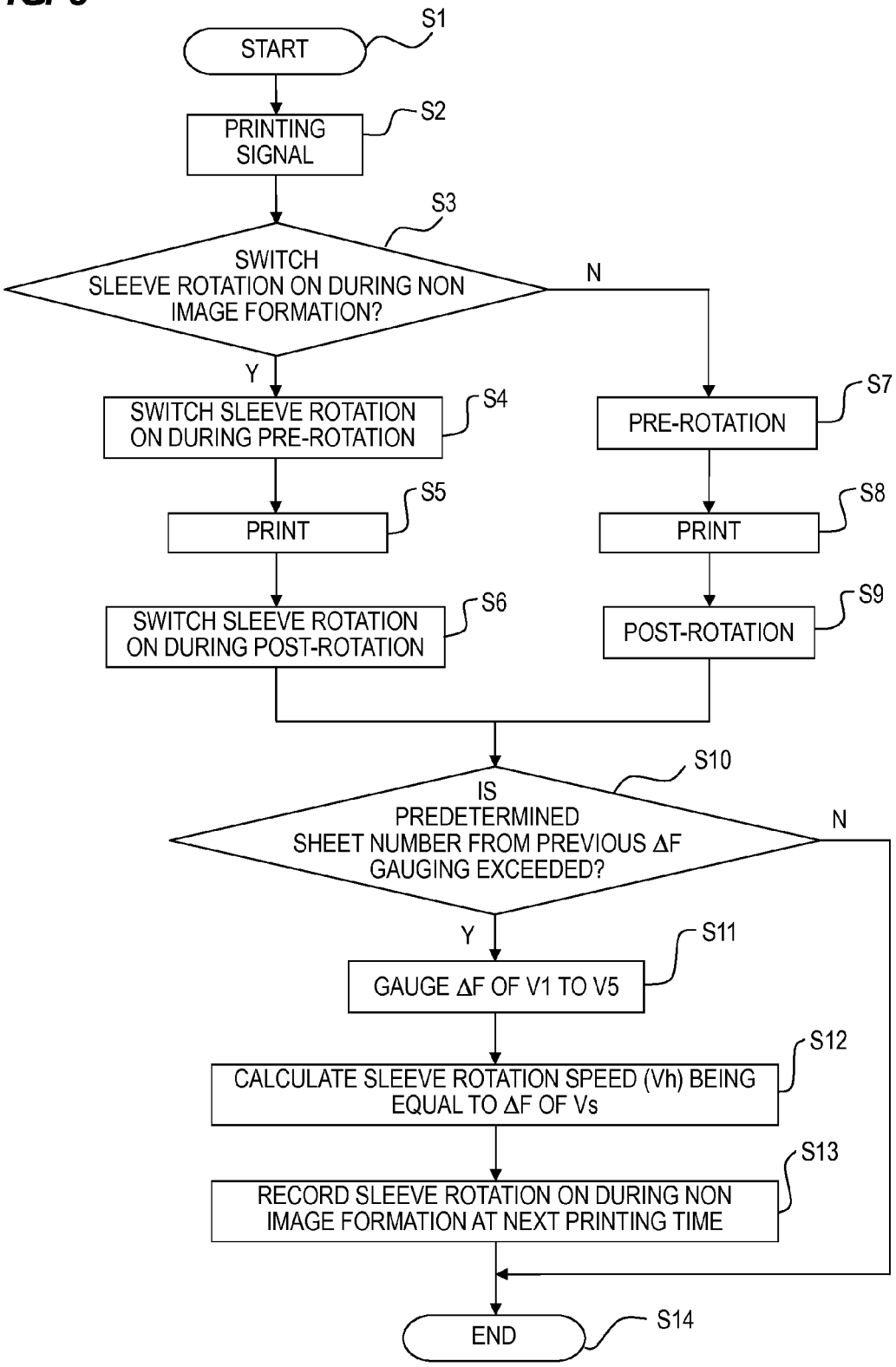
FIG. 6 is a flowchart of control for decreasing a dynamic torque change amount ΔF according to the first embodiment.

The development sleeve rotation speed during processes B, D and F is determined as illustrated in FIG. 6, in order to decrease the dynamic torque change amount ΔF.

Specifically, as illustrated in FIG. 6, control for decreasing the dynamic torque change amount ΔF is started (S1), and, when a printing signal is input (S2), it is determined from data recorded in the memory 104 whether to rotate the development sleeve 41 during a non image forming time, such as at pre-rotation, post-rotation, and inter-sheet rotation (S3). The first time gauging of ΔF is performed immediately after exchanging the photosensitive drum 1, and the memory 104 records the result from performing a measurement of dynamic torque change ΔF by control for initializing the photosensitive drum 1. A determination not to rotate the development sleeve 41 is made at S3 when ΔF is sufficiently small with respect to the change of the development sleeve speed.

When a determination to rotate the development sleeve 41 is made at S3, the pre-rotation is performed while rotating the development sleeve 41 (S4), printing is performed (S5), and the post-rotation is performed while rotating the development sleeve 41 (S6). On the other hand, when a determination not to rotate the development sleeve 41 is made at S3, the pre-rotation is performed without rotating the development sleeve 41 (S7), the printing is performed (S8), and the post-rotation is performed without rotating the development sleeve 41 (S9). At S5 and S8, the development sleeve 41 is rotated at a rotation speed during a normal printing operation.

It is then determined whether the number of image-formed sheets having been formed after the previous gauging of dynamic torque change has exceeded a predetermined number of sheets (S10). It is also possible to make a determination at S10 for each predetermined charging time, instead of making a determination for each predetermined number of image-formed sheets. When it is determined at S10 that the predetermined number of sheets is not exceeded, control is terminated (S14). When it is determined at S10 that the predetermined number of sheets is exceeded, the rotation speed of the development sleeve 41 is changed in five steps of V1 to V5, and the dynamic torque change amount ΔF is gauged (S11).

A comparison is made between ΔF gauged at S11 and ΔF obtained at a development sleeve rotation speed Vs during image formation. Then, among V1 to V5, a speed which does not cause image defects, the dynamic torque change amount ΔF of which is close to ΔF obtained at the development sleeve rotation speed Vs during image formation, and which is the slowest (smallest) is used as a development sleeve rotation speed (Vh) during a non image forming time, such as at the pre-rotation, the post-rotation, and the inter-sheet rotation (S12). According to the present embodiment, no image defects are assumed to occur when the ratio of dynamic torque difference ΔF between V and Vs having different rotation speeds with respect to dynamic torque at Vs falls within 5%. However, the above-mentioned ratio differs depending on the apparatus, and is not limited to the given value. It is also possible to assume, besides the above-mentioned method, that no image defects should occur when the dynamic torque difference ΔF between the V and Vs having different rotation speeds is a predetermined value or less.

Then, a command for executing a driving mode, which rotates the development sleeve 41 at a speed of Vh during a non image forming time, such as at pre-rotation, post-rotation, and inter-sheet rotation, from the next printing operation is input to the memory 104 (S13), and the control is ended (S14).

Second Embodiment

Figure 7:
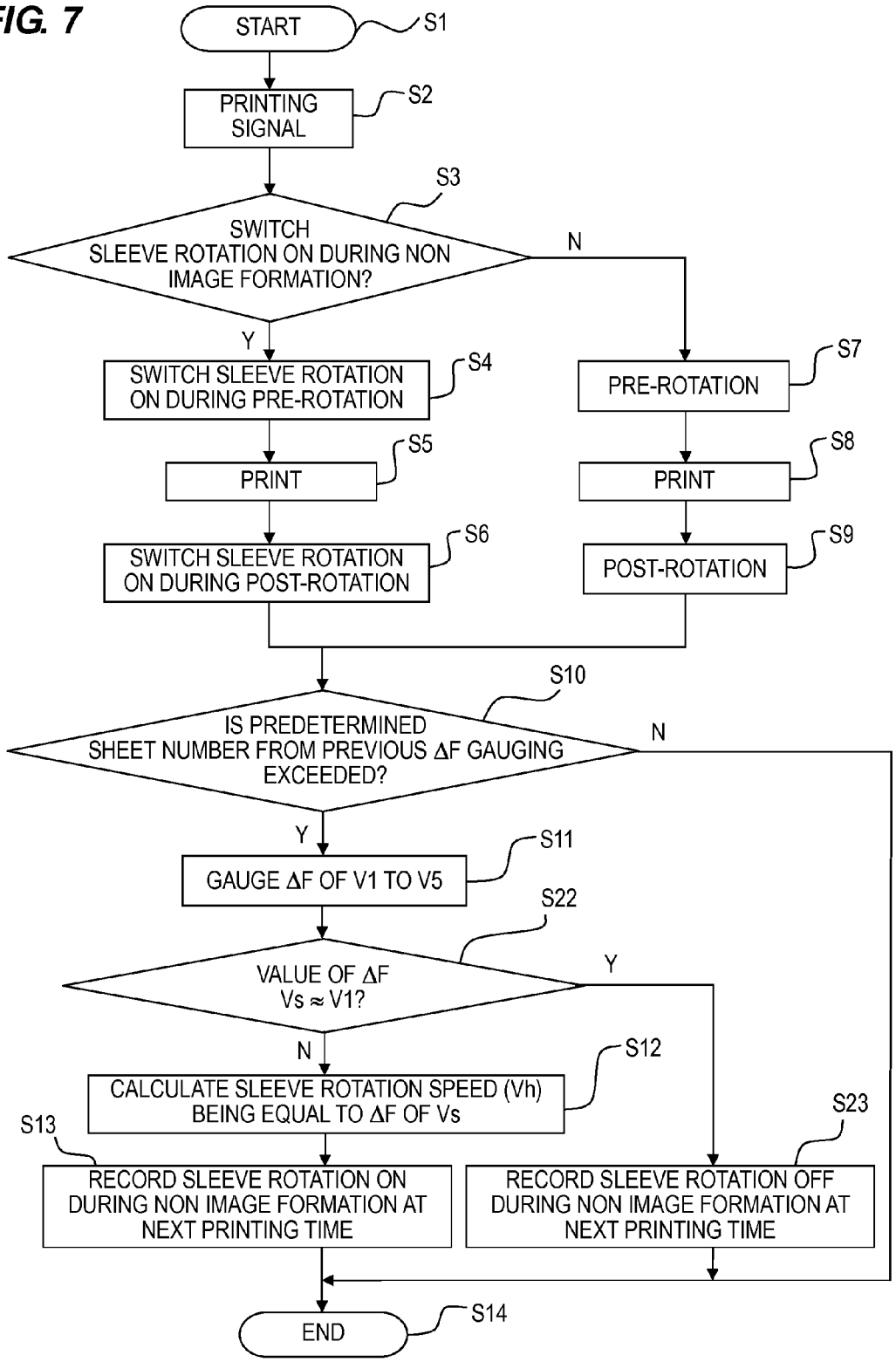
FIG. 7 is a flowchart of control for decreasing a dynamic torque change amount ΔF according to a second embodiment.

Next, a second embodiment of the image forming apparatus according to the present invention will be described with reference to the drawings. The same reference numerals are assigned to the same parts as in the first embodiment described above, and a description thereof will not be repeated herein. FIG. 7 is a flowchart of control for decreasing the dynamic torque change amount ΔF according to the present embodiment.

As illustrated in FIG. 7, the image forming apparatus according to the present embodiment has operations of S22 and S23 inserted between S11 and S12 of FIG. 6 of the above-described first embodiment. At S22 and S23, it is determined whether it is necessary to rotate the development sleeve 41 during a non image forming time, such as at pre-rotation, post-rotation, and inter-sheet rotation. In other words, when the dynamic torque change amount ΔF caused by presence/absence of rotation of the development sleeve 41 is sufficiently small, rotation of the development sleeve 41 during the non image forming time is stopped.

According to the present embodiment, in the same manner as in the above-described first embodiment, after performing operations at S1 to S11, the result of gauging at S11 (ΔF at V1 to V5) and ΔF obtained at Vs are compared, and it is determined whether the value of ΔF of V1 is close to the value of ΔF of Vs (S22).

When it is determined at S22 that ΔF of V1 and ΔF of Vs are close to each other, a record is made at the memory 104 so as to stop a development sleeve rotation during the non image forming time, such as at the pre-rotation, the post-rotation, and the inter-sheet rotation (S23), and the control is finished (S14).

On the other hand, when it is determined at S22 that there is a difference between ΔF of V1 and ΔF of Vs, operations of S12 and S13 are performed in the same manner as in the above-described first embodiment, and the control is finished (S14).

The control according to the present embodiment does not rotate the development sleeve 41 when there is no need to rotate the development sleeve 41 during a non image forming time, such as at the pre-rotation, the post-rotation, and the inter-sheet rotation, making it possible to reduce degradation of the developer resulting from rotation of the development sleeve 41.

Third Embodiment

Figure 8:
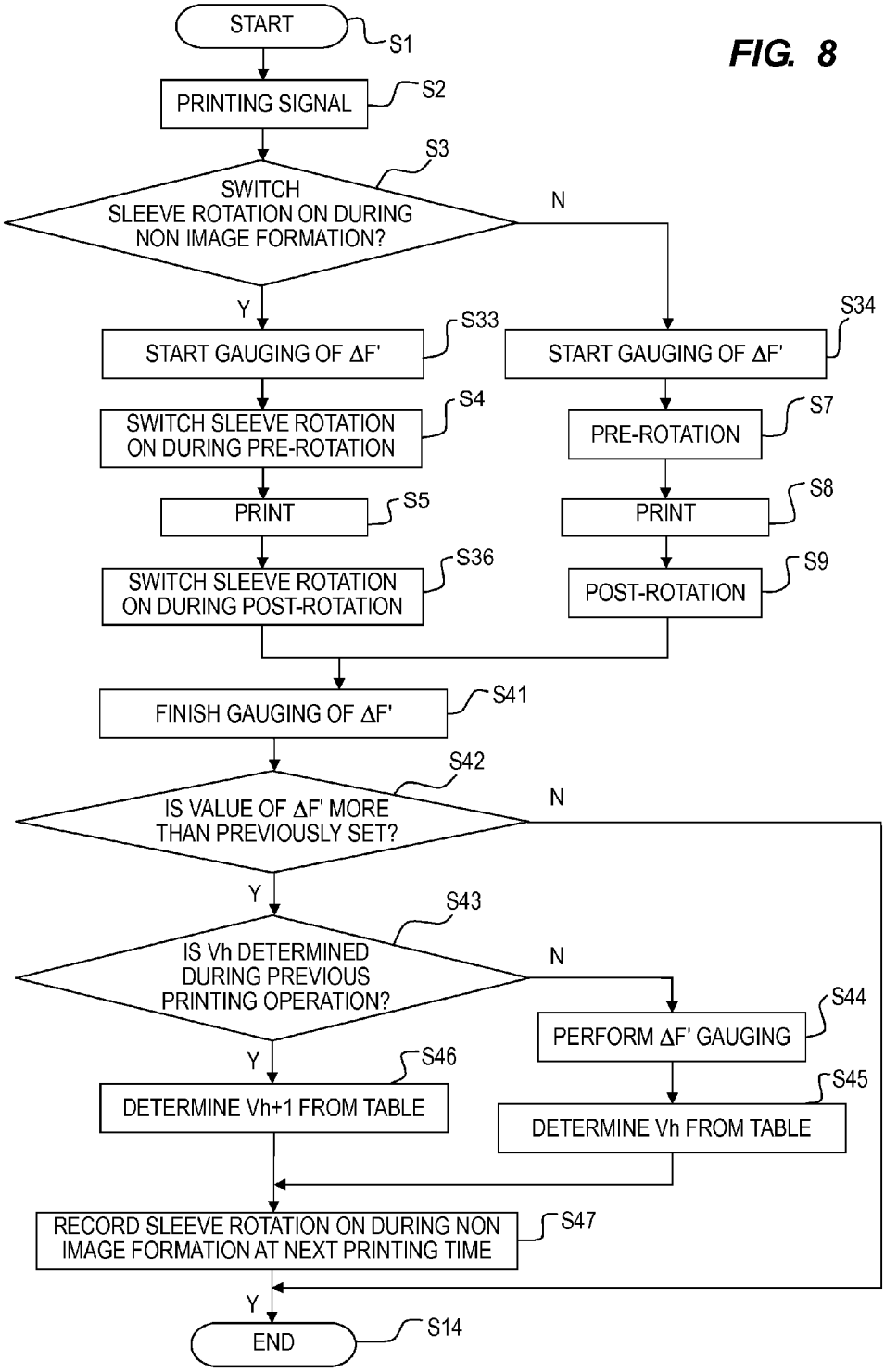
FIG. 8 is a flowchart of control for decreasing a dynamic torque change amount ΔF according to a third embodiment.

Next, a third embodiment of the image forming apparatus according to the present invention will be described with reference to the drawings. The same reference numerals are assigned to the same parts as in the first embodiment described above, and a description thereof will not be repeated herein. FIG. 8 is a flowchart of control for decreasing the dynamic torque change amount ΔF according to the present embodiment.

As illustrated in FIG. 8, the image forming apparatus according to the present embodiment has an operation of S33 inserted between S3 and S4 of FIG. 6 of the first embodiment described above, an operation of S34 inserted between S3 and S7 of FIG. 6, and operations of S41 to S47 substituted for S10 to S13 of FIG. 6.

The present embodiment is characterized in that the value of ΔF' during printing is always gauged, and the development sleeve 41 is operated at a predetermined rotation speed during pre-rotation and during post-rotation with respect to the value of ΔF'. In other words, during a normal printing operation, the value of change of dynamic torque (ΔF') from pre-rotation to image formation is gauged, and a corresponding rotation speed of the development sleeve 41 is selected from a table prepared in advance.

Specifically, the change of dynamic torque (ΔF') during passage from process B to process C of FIG. 3A is always gauged (S33, S41). If the value of ΔF' is larger than that when it has been previously gauged to set the rotation speed of the development sleeve 41 during non image formation, it is determined whether to enter a sequence (S43 to S47) for selecting a rotation speed of the development sleeve 41 corresponding to the gauged ΔF' (S42).

FIG. 9 is a diagram illustrating an example of a table determining levels 1 to 6 of ΔF' and development sleeve rotation speeds (Vh) during non image formation. As illustrated in FIG. 9, according to the present embodiment, six steps are set as the levels of ΔF' so that the value of ΔF' increases as the numerical value of level rises. The table of FIG. 9 is determined by acquiring in advance development sleeve rotation speeds (Vh), at which no image defects occur, based on experiments.

When the value of ΔF' is equal to or less than a predetermined value (for example, level 1) at S42, the control is ended (S14). On the other hand, when the value of ΔF' is equal to or larger than the predetermined value (for example, levels 2 to 6) at S42, it is determined whether the development sleeve rotation speed (Vh) has been determined during the previous printing operation (S43).

When it is determined at S43 that Vh has not been determined, ΔF' is gauged again (S44).

Then, rotation speed Vh of the development sleeve 41, which corresponds to the gauged ΔF', is selected from the table prepared in advance (S45). A record is made in the memory 104 so as to rotate the development sleeve 41 at a speed of Vh during pre-rotation and during post-rotation from the next printing operation (S46), and the control is ended (S14).

On the other hand, when it is determined at S43 that Vh has been determined, a record is made in the memory 104 so as to change the rotation speed of the development sleeve 41, from the table, to a speed (Vh+1) one step faster than the previously set speed (S46, S47), and the control is ended (S14).

The control according to the present embodiment predicts the change of ΔF resulting from a change of the rotation speed of the development sleeve 41, making it possible to shorten the time needed to execute a sequence for comparing ΔF and thereby suppress delay of the next printing operation.

Fourth Embodiment

Figure 10:
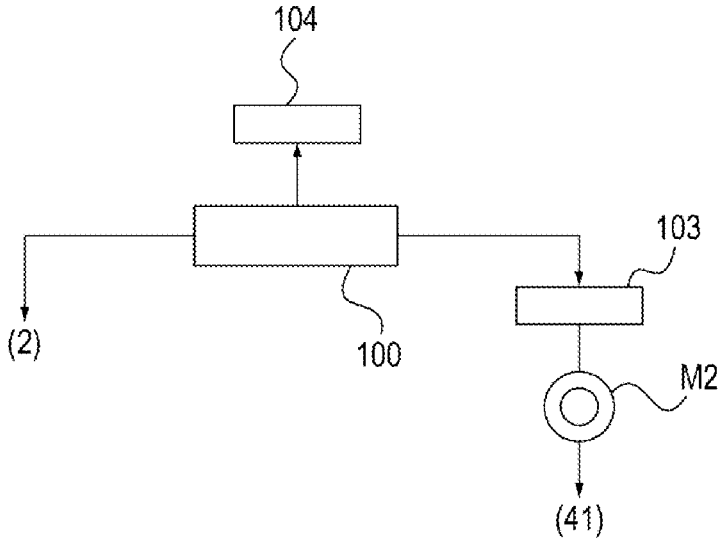
FIG. 10 is a block diagram of a controller of an image forming apparatus according to a fourth embodiment.
Figure 11:
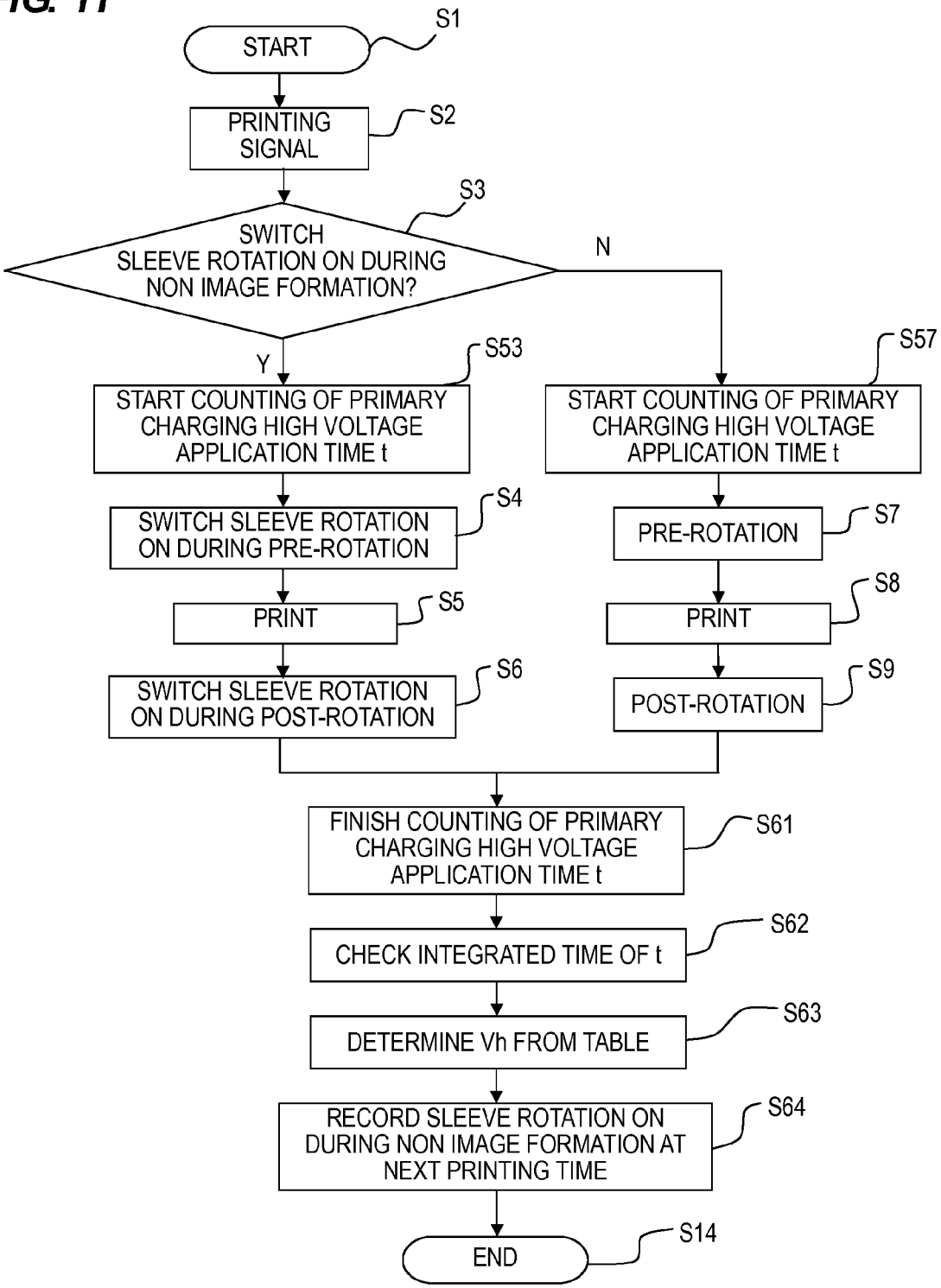
FIG. 11 is a flowchart of control for decreasing a dynamic torque change amount ΔF according to the fourth embodiment.
Figure 12A:
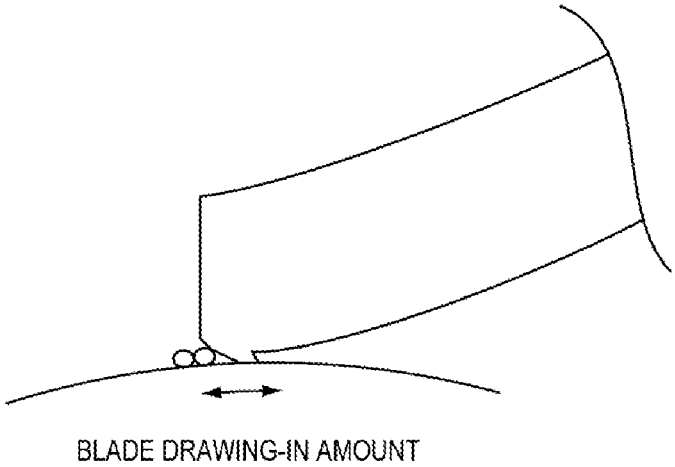
FIG. 12A PRIOR ART
FIG. 12A is a diagram illustrating an abutting state of an image bearing member and a cleaning blade while a frictional force between the image bearing member and the cleaning blade is high.
Figure 12B:
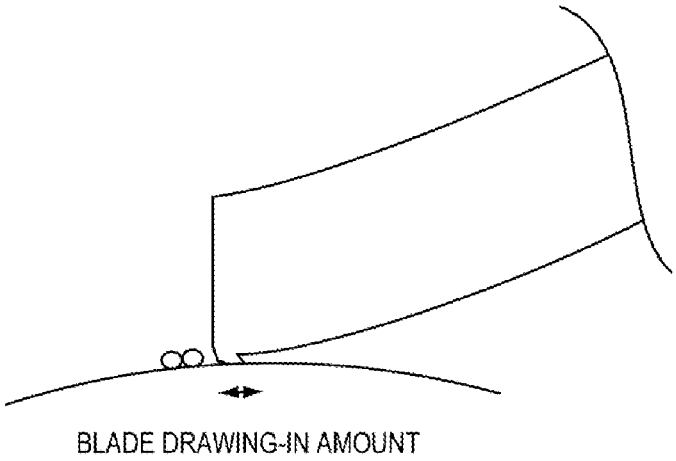
FIG. 12B PRIOR ART
FIG. 12B is a diagram illustrating an abutting state of the image bearing member and the cleaning blade while the frictional force is low.

Next, a fourth embodiment of the image forming apparatus according to the present invention will be described with reference to the drawings. The same parts as in the above-described first embodiment are given the same reference numerals, and repeated description thereof will be omitted herein. FIG. 10 is a block diagram of a controller of the image forming apparatus according to the present embodiment. FIG. 11 is a flowchart of control for decreasing the dynamic torque change amount ΔF according to the present embodiment.

As illustrated in FIG. 10 and FIG. 11, according to the present embodiment, driving load torque of the photosensitive drum 1 is predicted from accumulated application time of primary charging by the charging roller 2 (integrated time obtained by integrating charging time), and development sleeve rotation speed Vh during a non image forming time, such as at pre-rotation, post-rotation, and inter-sheet rotation, is set. In other words, development sleeve rotation speed Vh during a non image forming time, such as at the pre-rotation, the post-rotation, and the inter-sheet rotation, is set without performing driving torque gauging by the torque converter-type torque meter 102, as illustrated in FIG. 6A of the above-described first embodiment, based on a driving current value of the motor M1.

In the case of a photosensitive drum 1, the surface layer of which undergoes extremely little wear due to endurance, a frictional force of the surface of the photosensitive drum, which determines dynamic torque, can be predicted by an accumulated application time of primary charging. This is because the frictional force of the photosensitive drum rises due to attachment of discharge products resulting from the primary charging.

As illustrated in FIG. 11, according to the present embodiment, an accumulated charging high voltage application time since the start of using the photosensitive drum 1 is memorized in the memory 104. When a printing operation is started (S2), counting of a primary charging high voltage application time t is started (S53, S57). After post-rotation ends (S6, S9), the counting of the primary charging high voltage application time t is finished (S61).

The accumulated charging high voltage application time (integrated time of t) up to S61 is checked (S62). Then, the development sleeve rotation speed during pre-rotation, post-rotation, and inter-sheet rotation is determined based on a table of the integrated time and the development sleeve rotation speed during a non image forming time, such as at the pre-rotation, the post-rotation, and the inter-sheet rotation. The determined speed is recorded in the memory 104 (S63, S64), and the control is ended (S14).

If the photosensitive drum 1 is exchanged, the accumulated charging high voltage application time is reset, and development sleeve rotation during the non image forming time, such as at the pre-rotation, the post-rotation, and the inter-sheet rotation, is also switched off.

The control according to the present embodiment can suppress, even in the case of an image forming apparatus including no torque meter 102, slipping-through of toner from the contact portion between the cleaning blade 13 and the photosensitive drum 1, due to an abrupt torque change, in the same manner as in the above-described first to third embodiments.

Although a configuration of predicting the driving load torque of the photosensitive drum 1 based on accumulated application time of primary charging has been described in the present embodiment, a configuration of gauging the number of image-formed sheets, integrating the number, and predicting the driving load torque of the photosensitive drum 1 based on the integrated number of sheets is also possible.

Although a case of performing sleeve rotation during non image formation while a high charging voltage is applied has been described in the above description, it is also possible to perform sleeve rotation without application of charging, besides the above description.

Also, although a configuration of making direct transfer to the sheet P has been described in the above first to fourth embodiments, a configuration of transferring to an intermediate transfer belt (intermediate transfer member) and then transferring to the sheet P is also possible. Furthermore, an example of making the development sleeve rotation speed constant during the pre-rotation has been described in the present embodiments, a configuration of making a stepwise change is also possible.

According to the present invention, slipping-through of toner resulting from an abrupt change of the abutting state of the cleaning blade can be suppressed while suppressing degradation of the developer as much as possible.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-146421, filed Jun. 29, 2012, which is hereby incorporated by reference herein in its entirety.

What is claimed is:

1. An image forming apparatus comprising:

an image bearing member configured to bear an electrostatic latent image;

a developer bearing member configured to bear a developer on a surface and develop the electrostatic latent image borne by the image bearing member as a toner image;

a cleaning blade configured to abut onto the image bearing member and clean the developer remaining on the image bearing member after transfer;

a sensing portion configured to sense a rotation load of the image bearing member; and a controller configured to perform control such that a driving mode can be performed to drive the developer bearing member at a lower speed than that during an image forming time when the image bearing member is rotated during non image formation, wherein the controller is enabled to perform a torque sensing mode which determines whether to perform the driving mode or determines a driving speed of the developer bearing member during the driving mode, based on a first dynamic torque of the image bearing member when the developer bearing member is rotated at a first speed and a second dynamic torque of the image bearing member when the developer bearing member is stopped or when the developer bearing member is rotated at a second speed smaller slower than the first speed.

2. The image forming apparatus according to claim 1, wherein the controller is configured to select a smallest rotation speed among rotation speeds, which have respective dynamic torque differences equal to or less than a predetermined value, as a rotation speed of the developer bearing member during non image formation, the dynamic torque differences being differences between respective dynamic torques of the image bearing member when the rotation speed of the developer bearing member is rotated after switching to at least two rotation speeds equal to or less than a rotation speed during image formation and dynamic torque of the image bearing member when the developer bearing member is rotated at the rotation speed during image formation.

3. The image forming apparatus according to claim 1, wherein the first speed is a speed of the developer bearing member during the image forming time, the second speed is a speed set during a period of pre-rotation, which rotates the image bearing member in advance following an image formation start, and the controller is configured to perform control such that, as the difference becomes larger, a driving speed of the developer bearing member increases when the image bearing member is rotated during non image formation.

4. The image forming apparatus according to claim 1, wherein the image forming apparatus further comprises a charging time gauging portion configured to gauge a charging time of the image bearing member, and the controller is configured to determine whether to perform the torque sensing mode based on a gauging result of the charging time gauging portion.

5. The image forming apparatus according to claim 1, wherein the image forming apparatus further comprises an image-formed sheet number counting unit configured to count the image-formed sheet number, and the controller is configured to determine whether to perform the torque sensing mode based on a counting result of the image-formed sheet number counting unit.

6. The image forming apparatus according to claim 1, wherein the controller is configured not to perform the driving mode when a difference between the first torque and the second torque is equal to or less than a predetermined value.

7. An image forming apparatus comprising:

an image bearing member configured to bear an electrostatic latent image;

a developer bearing member configured to bear a developer on a surface and develop the electrostatic latent image borne by the image bearing member as a toner image;

a cleaning blade configured to abut onto the image bearing member and clean the developer remaining on the image bearing member after transfer;

a controller configured to perform control such that a driving mode can be performed to drive the developer bearing member at a lower speed than that during an image forming time when the image bearing member is rotated during non image formation; and a charging time gauging portion configured to gauge a charging time of the image bearing member, wherein the controller is configured to control whether to perform the driving mode or control a rotation speed of the developer bearing member during the driving mode, based on a gauging result from the charging time gauging portion.

8. The image forming apparatus according to claim 7, wherein the controller is configured to make a rotation speed of the developer bearing member during the driving mode when the gauging result from the charging time gauging portion is equal to or more than a predetermined time faster than a rotation speed when the gauging result is equal to or less than the predetermined time.

9. The image forming apparatus according to claim 7, wherein the controller is configured to perform the driving mode when the gauging result from the charging time gauging portion is equal to or larger than a predetermined threshold value.

10. An image forming apparatus comprising:

an image bearing member configured to bear an electrostatic latent image;

a developer bearing member configured to bear a developer on a surface and develop the electrostatic latent image borne by the image bearing member as a toner image;

a cleaning blade configured to abut onto the image bearing member and clean the developer remaining on the image bearing member after transfer;

a controller configured to perform control such that a driving mode can be performed to drive the developer bearing member at a lower speed than that during an image forming time when the image bearing member is rotated during non image formation; and an image-formed sheet number detecting portion configured to detect information about the image-formed sheet number, wherein the controller is configured to control whether to perform the driving mode or control a rotation speed of the developer bearing member during the driving mode, based on a counting result from the image-formed sheet number detecting portion.

11. The image forming apparatus according to claim 10, wherein the controller is configured to make a rotation speed of the developer bearing member during the driving mode when the counting result from the image-formed sheet number detecting portion is equal to or greater than a predetermined sheet number faster than a rotation speed when the gauging result is equal to or less than the predetermined sheet number.

12. The image forming apparatus according to claim 10, wherein the controller is configured to perform the driving mode when the counting result from the image-formed sheet number detecting portion is equal to or greater than a predetermined threshold value.

* * * * *